US011017994B2

(12) United States Patent
Malpas et al.

(10) Patent No.: US 11,017,994 B2
(45) Date of Patent: May 25, 2021

(54) ION GUIDE

(71) Applicant: MICROMASS UK LIMITED, Wilmslow (GB)

(72) Inventors: Oliver John Malpas, Congleton (GB); James Paul Harrison, Stockport (GB); Bharat Chande, Dunkinfield (GB); John Iveson, Manchester (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 16/611,894

(22) PCT Filed: Jul. 6, 2018

(86) PCT No.: PCT/GB2018/051929
§ 371 (c)(1),
(2) Date: Nov. 8, 2019

(87) PCT Pub. No.: WO2019/008391
PCT Pub. Date: Jan. 10, 2019

(65) Prior Publication Data

US 2020/0135442 A1 Apr. 30, 2020

(30) Foreign Application Priority Data

Jul. 6, 2017 (GB) ..... 1710868

(51) Int. Cl.
*H01J 49/06* (2006.01)

(52) U.S. Cl.
CPC ..... *H01J 49/063* (2013.01); *H01J 49/065* (2013.01); *H01J 49/068* (2013.01)

(58) Field of Classification Search
CPC ..... H01J 49/06; H01J 49/063; H01J 49/065; H01J 49/068; H01J 49/42; H01J 49/4215
See application file for complete search history.

(56) References Cited

U.S. PATENT DOCUMENTS 5,298,745 A * 3/1994 Kernan ..... G21K 1/087 250/292
7,391,021 B2 * 6/2008 Stoermer ..... H01J 49/065 250/281

(Continued)

FOREIGN PATENT DOCUMENTS

EP 0268048 A2 5/1988
GB 2274199 A 7/1994

(Continued)

OTHER PUBLICATIONS

Search Report in U.K. Patent Application No. GB1710868.9 dated Nov. 29, 2017; 4 pages.

(Continued)

*Primary Examiner* — David E Smith
(74) *Attorney, Agent, or Firm* — Schmeiser, Olsen & Watts LLP

(57) ABSTRACT

An ion guide is disclosed that comprises a plurality of electrodes arranged to form a multipole ion guide and one or more rigid support members. The plurality of electrodes comprises one or more groups of electrodes, and each group of electrodes comprises plural electrodes that are axially spaced apart from one another. The electrodes of one or more groups of electrodes are attached to one of the one or more rigid support members. One or more of the electrodes comprises a curved metal sheet, plate or strip.

14 Claims, 13 Drawing Sheets

(56) References Cited

U.S. PATENT DOCUMENTS

| | | | | |
|---|---|---|---|---|
| 8,207,491 | B2 * | 6/2012 | Okumura | H01J 49/065 250/281 |
| 8,779,353 | B2 * | 7/2014 | Zanon | H01J 49/065 250/281 |
| 9,870,906 | B1 * | 1/2018 | Quarmby | H01J 49/4215 |
| 2006/0076485 | A1 * | 4/2006 | Stoermer | H01J 49/065 250/290 |
| 2007/0284524 | A1 | 12/2007 | Franzen | |
| 2010/0301227 | A1 | 12/2010 | Muntean | |
| 2012/0292498 | A1 * | 11/2012 | Jiang | H01J 49/4225 250/282 |
| 2013/0015347 | A1 | 1/2013 | Steiner | |
| 2015/0228467 | A1 | 8/2015 | Grinfeld et al. | |

FOREIGN PATENT DOCUMENTS

| | | | |
|---|---|---|---|
| GB | 2422051 | A | 7/2006 |
| GB | 2438698 | A | 12/2007 |
| GB | 2439789 | A | 1/2008 |
| WO | 2008067331 | A2 | 6/2008 |
| WO | 2017194974 | A1 | 11/2017 |

OTHER PUBLICATIONS

International Search Report and Written Opinion in PCT/GB2018/051929 dated Oct. 4, 2018; 13 pages.

* cited by examiner

Priort art

ION GUIDE

CROSS-REFERENCE TO RELATED APPLICATION

This application claims priority from and the benefit of United Kingdom patent application No. 1710868.9 filed on 6 Jul. 2017. The entire content of this application is incorporated herein by reference.

FIELD OF THE INVENTION

The present invention relates generally to ion guides and in particular to multipole ion guides.

BACKGROUND

The use of multipole ion guides in mass spectrometers is widespread. Multipole ion guides are normally created using plural metal rods arranged symmetrically around a central axis. For example, four rods may be used to create a quadrupole ion guide, six rods may be used to create a hexapole ion guide, and eight rods may be used to create an octopole ion guide. Opposite phases of a radio frequency (RF) voltage are applied to adjacent rods in order to confine ions radially within the ion guide.

It is desired to provide an improved ion guide.

SUMMARY

According to an aspect there is provided an ion guide comprising:

a plurality of electrodes arranged to form a multipole ion guide;

wherein one or more of the electrodes comprises a curved metal sheet, plate or strip.

According to an aspect there is provided an ion guide comprising:

a plurality of electrodes arranged to form a multipole ion guide, wherein the plurality of electrodes comprises one or more groups of electrodes, and each group of electrodes comprises plural electrodes that are axially spaced apart from one another; and one or more rigid support members, wherein the electrodes of one or more groups of electrodes are attached to one of the one or more rigid support members;

wherein one or more of the electrodes comprises a curved metal sheet, plate or strip.

Various embodiments are directed to an ion guide comprising a plurality of electrodes that are arranged in the manner of a multipole ion guide. In contrast with known ion guides, one or more (or each) of the electrodes comprises a curved metal sheet, plate or strip.

As will be described in more detail below, the Applicants have found that the use of curved metal sheet, plate or strip electrodes (i.e. instead of conventional rod electrodes) is particularly beneficial, since for example, it provides an ion guide that is significantly easier to produce, assemble, disassemble, and clean. This in turn results in an ion guide having an improved production yield, reduced production cost, reduced maintenance cost, and improved performance.

It will be appreciated, therefore, that various embodiments provide an improved ion guide.

The plurality of electrodes may be arranged to form a segmented multipole ion guide.

The plurality of electrodes may comprise plural groups of electrodes that are angularly spaced apart from one another.

The plurality of electrodes may comprise plural first groups of electrodes that are angularly spaced apart from one another. That is, each first group of electrodes may be angularly spaced apart from each other first group of electrodes.

Each first group of electrodes may comprise plural electrodes that are axially spaced apart from one another. That is, each electrode in a first group of electrodes may be axially spaced apart from each other electrode in that first group.

The plurality of electrodes may comprise plural second groups of electrodes that are axially spaced apart from one another. That is, each second group of electrodes may be axially spaced apart from each other second group of electrodes.

Each second group of electrodes may comprise plural electrodes that are angularly spaced apart from one another. That is, each electrode in a second group of electrodes may be angularly spaced apart from each other electrode in that second group.

Each electrode of the plurality of electrodes may be part of both a first group and a second group.

The ion guide may comprise:

a radio frequency (RF) voltage source configured to apply an RF voltage to the electrodes; and/or a DC voltage source configured to apply a DC voltage gradient to the electrodes; and/or a DC voltage source configured to apply a travelling DC voltage to the electrodes.

The metal sheet, plate or strip may be relatively thin in a first (thickness) dimension and relatively extended in second (width) and third (length) dimensions.

The metal sheet, plate or strip may be curved in the first (thickness) dimension.

The curved metal sheet, plate or strip may comprise two curved faces.

The curved metal sheet, plate or strip electrode may be arranged such that the two curved faces are substantially parallel to an axial direction of the ion guide.

The curved metal sheet, plate or strip electrode may comprise one or more legs and a curved portion.

The curved metal sheet, plate or strip electrode may comprise a monolithic curved metal sheet, plate or strip comprising the one or more legs and the curved portion.

The curved portion may have a rectangular, round, hyperbolic or other profile.

The curved metal sheet, plate or strip electrode may have a substantially regular or deformed J-shape, hook-shape, U-shape or horseshoe-shape.

At least part of the curved metal sheet, plate or strip electrode may have a substantially regular or deformed J-shape or hook-shape. The curved metal sheet, plate or strip electrode may have a substantially regular or deformed U-shape or horseshoe-shape.

The curved metal sheet, plate or strip electrode may comprise one or more protrusions.

The curved metal sheet, plate or strip electrode may comprise one or more recesses adjacent to one or more of the one or more protrusions.

The ion guide may comprise one or more rigid support members.

Each electrode of the plurality of electrodes may be attached to one of the one or more rigid support members.

Each of the rigid support members may comprise one or plural holes.

Each electrode protrusion may be arranged inside a hole of the rigid support member.

Each electrode of the plurality of electrodes may be soldered to one of the one or more rigid support members.

Each curved metal sheet, plate or strip electrode may be directly attached only to a single rigid support member.

The electrodes of two of the angularly spaced groups of electrodes may be attached to a single rigid support member.

The electrodes of first and second angularly spaced groups of electrodes may be attached to a first rigid support member.

The electrodes of third and fourth angularly spaced groups of electrodes may be attached to a second rigid support member.

The first rigid support member may be attached to the second rigid support member.

According to as aspect, there is provided an assembly for a multipole ion guide comprising:

a rigid support member; and a plurality of electrodes attached to the rigid support member;

wherein one or more of the electrodes comprises a curved metal sheet, plate or strip.

Each electrode may comprise one or more protrusions.

The rigid support member may comprise plural holes.

Each electrode protrusion may be arranged inside a hole of the rigid support member.

Each electrode may be soldered to the rigid support member.

The plurality of electrodes may comprise two parallel rows of electrodes attached to the rigid support member.

According to as aspect there is provided an electrode for a multipole ion guide comprising a curved metal sheet, plate or strip.

According to an aspect there is provided an electrode for a multipole ion guide comprising a curved metal sheet, plate or strip comprising one or more legs joined by a curved portion, wherein:

the metal sheet, plate or strip is relatively thin in a first dimension and relatively extended in second and third dimensions; and the metal sheet, plate or strip is curved in the first dimension.

According to as aspect, there is provided a method of guiding ions comprising:

providing an ion guide comprising a plurality of electrodes arranged to form a multipole ion guide, wherein one or more of the electrodes comprises a curved metal sheet, plate or strip; and applying a radio frequency (RF) voltage to the electrodes in order to radially confine ions within the ion guide.

According to an aspect there is provided a method of guiding ions comprising:

providing an ion guide comprising a plurality of electrodes arranged to form a multipole ion guide and one or more rigid support members, wherein the plurality of electrodes comprises one or more groups of electrodes, and each group of electrodes comprises plural electrodes that are axially spaced apart from one another, wherein the electrodes of one or more groups of electrodes are attached to one of the one or more rigid support members, and wherein one or more of the electrodes comprises a curved metal sheet, plate or strip; and applying a radio frequency (RF) voltage to the electrodes in order to radially confine ions within the ion guide.

According to as aspect, there is provided a method of forming an assembly for a multipole ion guide comprising:

arranging plural electrodes in a jig, wherein each electrode comprises a curved metal sheet, plate or strip comprising one or more protrusions;

arranging a rigid support member comprising plural holes such that each electrode protrusion is arranged inside a hole of the rigid support member; and attaching each electrode protrusion to the rigid support member.

Attaching each electrode protrusion to the rigid support member may comprise soldering each electrode protrusion to the rigid support member.

The plural electrodes may comprise two parallel rows of electrodes.

BRIEF DESCRIPTION OF THE DRAWINGS

Various embodiments will now be described, by way of example only, and with reference to the accompanying drawings in which.

DETAILED DESCRIPTION

Multipole ion guides are normally created using plural metal rods arranged symmetrically around a central axis. For example, four rods may be used to create a quadrupole ion guide, six rods may be used to create a hexapole ion guide, and eight rods may be used to create an octopole ion guide. Opposite phases of a radio frequency (RF) voltage are applied to adjacent rods in order to confine ions radially within the ion guide.

It is also possible to segment the rods along their length (axially) into multiple rod segments, i.e. in order to form a segmented rod multipole ion guide. In this case, opposite phases of an RF voltage can be applied to adjacent rods in order to confine ions radially within the ion guide, and a DC voltage gradient can be applied along the length of the ion guide to form an axial electric field which will urge ions axially through the ion guide.

The rods or rod segments can have a rectangular, round, hyperbolic or other cross section, and are typically formed by a subtractive machining process. This is can be relatively difficult, time consuming, and costly.

Figure 1:
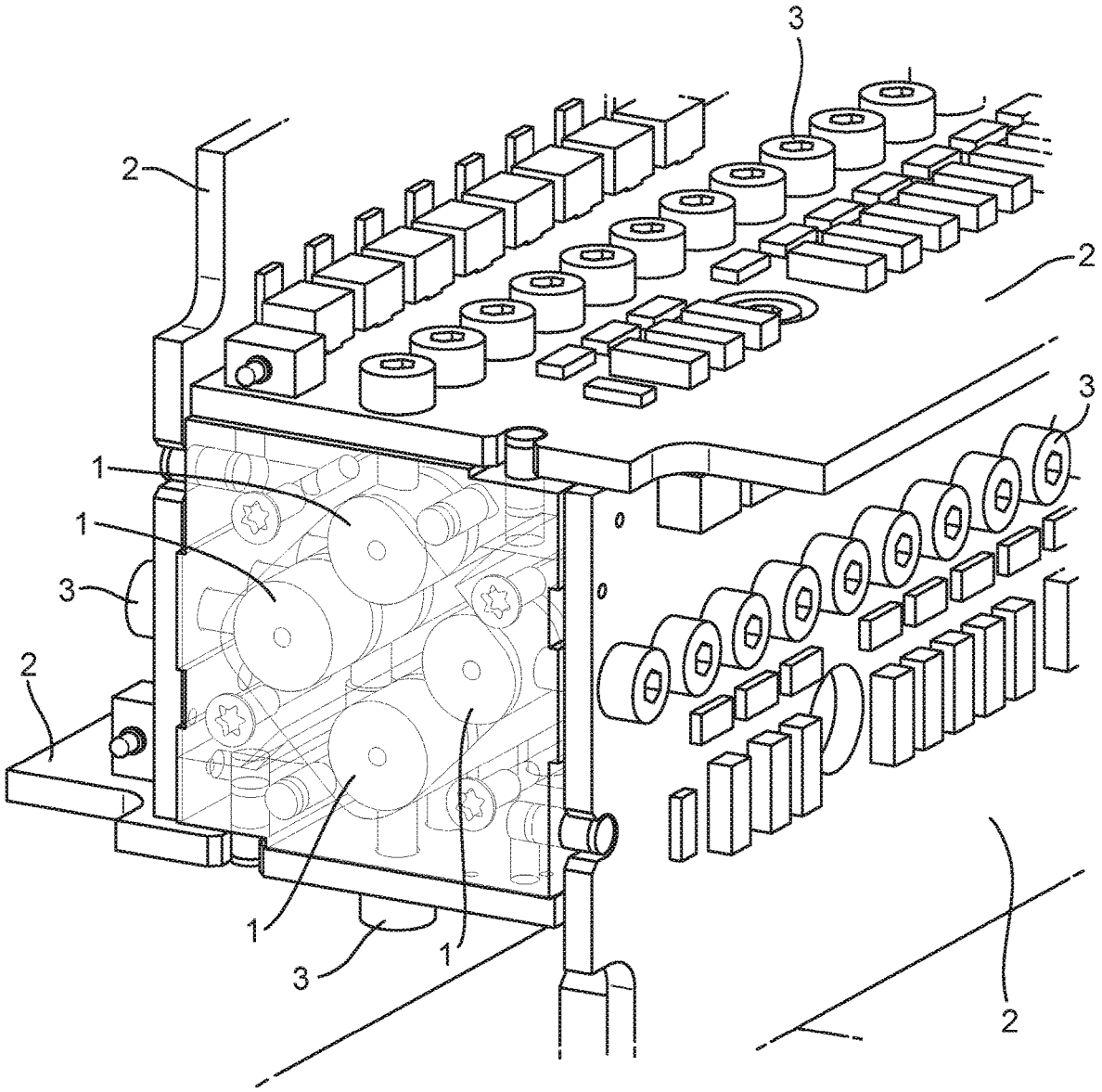
Fig. 1 Prior art
FIG. 1 shows schematically a quadrupole ion guide.
Figure 2:
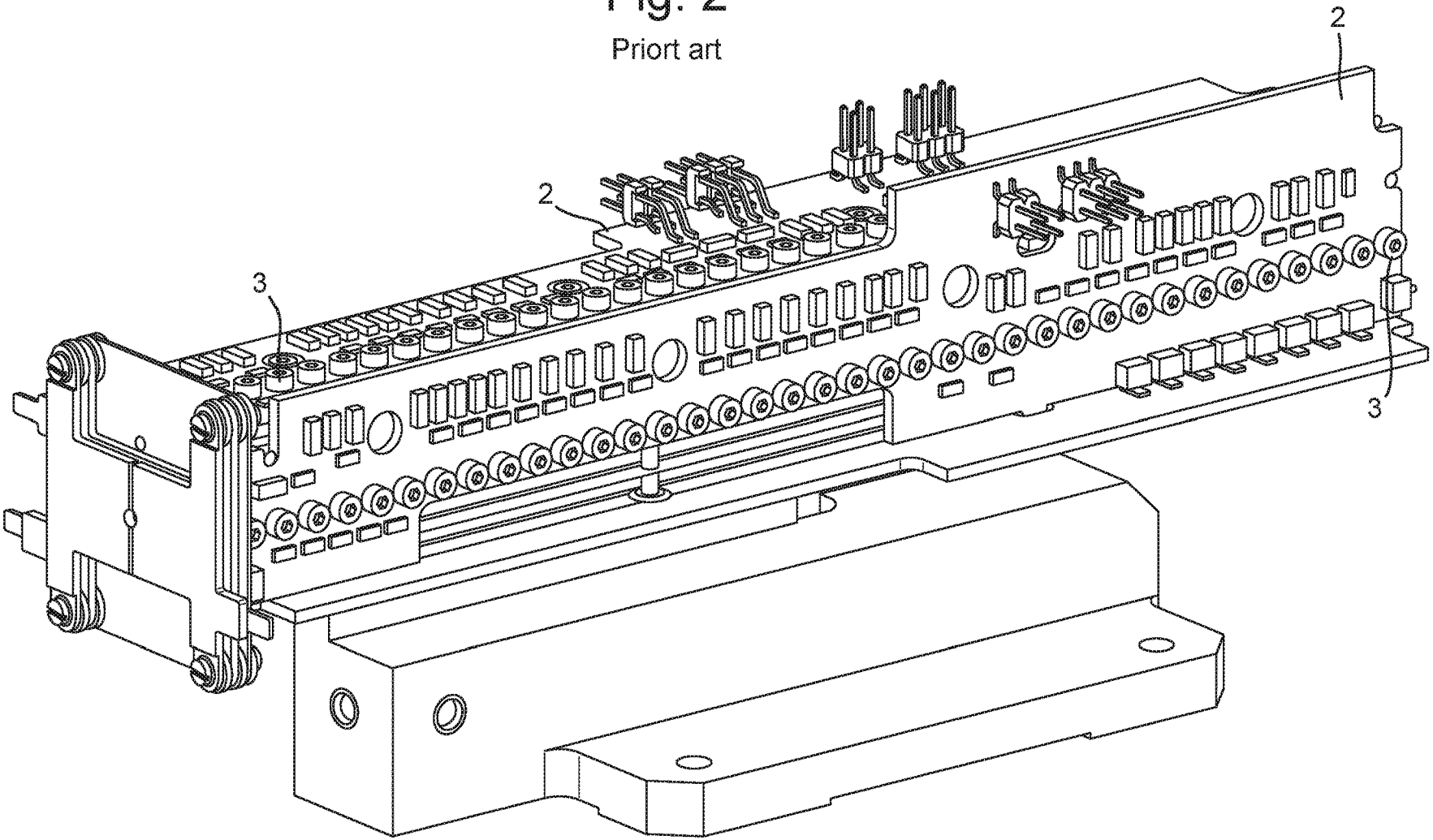
FIG. 2 shows schematically a quadrupole ion guide.

A known segmented quadrupole ion guide is illustrated schematically in FIGS. 1 and 2. As shown in FIG. 1, the ion guide comprises four groups of electrodes 1 that are arranged symmetrically around a central axis of the ion guide. Each group of electrodes 1 in effect comprises a cylindrical rod that has been segmented into multiple rod segments along the (axial) length of the rod.

As shown in FIG. 1, each rod segment electrode 1 in the known segmented quadrupole ion guide is individually attached to a rigid support 2 using a screw 3. During assembly, each electrode 1 is manually attached to the support 2 using a screw 3.

This screw connection can be awkward, since for example, all of the screws 3 must be very precisely tightened, so that all of the electrodes 1 are precisely aligned with one another. If the electrodes 1 are not precisely aligned with one another, the performance of the ion guide will be degraded.

Since, as shown in FIG. 2, the known ion guide typically comprises a large number of segmented rod electrodes 1, this means that assembling the known ion guide is difficult, time consuming, and costly.

Furthermore, cleaning the known ion guide is challenging. This is because in particular, as shown in FIG. 1, the segment electrodes 1 are relatively closely spaced apart from one another. This means that it can be difficult to ensure that cleaning fluid reaches all of the surfaces of the electrodes 1 and/or that cleaning fluid can become trapped in the spaces between electrodes 1. This is problematic since the ion guide can be very sensitive to contamination (for example, fingerprints on the electrodes 1 can significantly degrade the performance of the ion guide), and so the ion guide must be thoroughly cleaned prior to assembly, and will often need to be cleaned after assembly.

As such, cleaning of the known ion guide typically requires that the entire ion guide is disassembled, cleaned and reassembled. This process is again difficult, time consuming, and costly.

According to various embodiments, an ion guide is provided that comprises a plurality of electrodes arranged to form a multipole ion guide. One or more or each of the electrodes comprises a curved metal sheet, plate or strip.

As will be described in more detail below, the Applicants have found that the use of curved metal sheet, plate or strip electrodes in a multipole ion guide (i.e. instead of conventional rod electrodes or segmented rod electrodes 1) is particularly beneficial, since for example, it provides a multipole ion guide that is significantly easier to produce, assemble, disassemble, and clean. This in turn results in an ion guide that has an improved production yield, reduced production cost, reduced maintenance cost, and improved performance.

According to various embodiments, the ion guide comprises a central (longitudinal) axis, i.e. that extends in an axial (z) direction.

The ion guide may be configured such that ions are confined within the ion guide in a radial (r) direction (where the radial direction is orthogonal to, and extends outwardly from, the axial direction). Ions may be radially confined substantially along (in close proximity to) the central axis. In use, ions may travel through the ion guide substantially along (in close proximity to) the central axis.

According to various embodiments, the plurality of electrodes is arranged in the manner of a multipole ion guide (and the ion guide comprises a multipole ion guide). Thus, according to various embodiments, the electrodes are arranged in a rotationally symmetric manner around the central axis.

The ion guide may comprise a segmented multipole ion guide (i.e. where the ion guide comprises plural electrodes that are spaced apart in the axial direction). However, it would also be possible for the ion guide to comprise a non-segmented multipole ion guide.

According to various embodiments (where the ion guide comprises a segmented multipole ion guide), the plurality of electrodes is arranged into plural first groups of electrodes. Each first group of electrodes comprises plural electrodes that are (equally) spaced apart in the axial direction. Each first group of electrodes comprises plural electrodes which are arranged along a straight line, where the straight line is parallel to and offset (in the radial direction) from the central axis of the ion guide. The plural electrodes of each first group of electrodes may all have the same orientation (i.e. may be parallel) and may be aligned with one another along the straight line (in the axial direction).

Alternatively (where the ion guide comprises a non-segmented multipole ion guide), each electrode of the plurality of electrodes may comprise an electrode that is relatively extended in the axial direction. Each such electrode may be extended along a straight line, where the straight line is parallel to and offset (in the radial direction) from the central axis of the ion guide.

The plurality of electrodes may be arranged into any suitable number of such first groups of electrodes (or the ion guide may comprise any suitable plural number of extended electrodes). According to various embodiments, the plurality of electrodes is arranged into an even number of four or more first groups of electrodes (or the ion guide comprises four or more extended electrodes).

Thus, for example, where the multipole ion guide comprises a quadrupole ion guide the ion guide may comprise four first groups of electrodes (or four extended electrodes); where the ion guide comprises a hexapole ion guide, the ion guide may comprise six first groups of electrodes (or six extended electrodes); where the ion guide comprises an octopole ion guide, the ion guide may comprise eight first groups of electrodes (or eight extended electrodes); where the ion guide comprises a decapole ion guide, the ion guide may comprise ten first groups of electrodes (or ten extended electrodes); where the ion guide comprises a dodecapole ion guide the ion guide may comprise twelve first groups of electrodes (or twelve extended electrodes); and so on.

Each of the first groups of electrodes (or each of the plural extended electrodes) (each of the straight lines) may be offset in the radial direction from the central axis of the ion guide by the same radial distance, but may have different angular (azimuthal) displacements (with respect to the central axis) (where the angular direction (θ) is orthogonal to the axial (z) direction and the radial (r) direction). Each of the first groups of electrodes (or each of the plural extended electrodes) may be equally spaced apart in the angular (θ) direction.

Each first group of electrodes may be arranged to be opposed to another of the first groups of electrodes (or each extended electrode may be arranged to be opposed to another of the extended electrodes) in the radial direction.

That is, for each first group of electrodes of the plural first groups of electrodes that is arranged at a particular angular displacement $\theta_n$ with respect to the central axis of the ion guide, another of the first groups of electrodes is arranged at an angular displacement $\theta_n \pm 180°$.

Each first group of electrodes may comprise the same number of electrodes as one or more or each of the other first group of electrodes. The electrodes in each first group of electrodes may be equally spaced apart in the axial direction. Each of the electrodes within each first group of electrodes may be aligned (in the axial direction) with a corresponding electrode of one or more or each of the other first groups of electrodes.

It will accordingly be appreciated that the plurality of electrodes may also be considered as being divided into (may comprise) plural second groups of electrodes, i.e. where each second group of electrodes is axially spaced apart from each other second group of electrodes, and where each electrode of the plurality of electrodes may be considered as being part of both a (single) first group of electrodes and a (single) second group of electrodes.

Each second group of electrodes may comprise plural electrodes that are angularly spaced apart from one another. That is, each electrode in a second group of electrodes may be angularly spaced apart from each other electrode in that second group. The number of electrodes in each second group of electrodes will be equal to the number of first groups of electrodes (i.e. the number of poles of the multipole ion guide).

Each first group of electrodes may comprise any suitable number of electrodes (and the plurality of electrodes may comprise any suitable number of second groups of electrodes) such as (i) 2-5 (second groups of) electrodes; (ii) 5-10 (second groups of) electrodes; (iii) 10-50 (second groups of) electrodes; (iv) 50-100 (second groups of) electrodes; (v) 100-500 (second groups of) electrodes; (vi) 500-1000 (second groups of) electrodes; or (vii) >1000 (second groups of) electrodes.

According to various embodiments, a radio frequency (RF) voltage is applied to the electrodes in order to confine ions radially within the ion guide (i.e. so as to generate a pseudo-potential well that acts to confine ions radially within the ion guide), and the ion guide may comprise an RF voltage source configured to apply the RF voltage to the electrodes.

Opposite phases of the RF voltage may be applied to adjacent first groups of electrodes (or to adjacent extended electrodes). That is, an RF voltage may be applied to the electrodes of a particular first group of electrodes (or to a particular extended electrode), and the opposite phase of the RF voltage (180° out of phase) may be applied to the adjacent (in the angular (θ) direction) first groups of electrodes (or to the extended electrodes). The same phase of the radio frequency (RF) voltage may be applied to opposing first groups of electrodes (or opposing extended electrodes).

According to various embodiments, a DC voltage gradient may be applied to the electrodes in order to urge ions (in the axial direction) though the ion guide (i.e. so as to generate an axial electric field that acts to urge ions axially though the ion guide), and the ion guide may comprise a DC voltage source configured to apply the DC voltage gradient to the electrodes. That is, different DC voltages may be applied to different axially spaced electrodes (in one or more or each first group of electrodes) so as to create a DC voltage gradient that urges ions within the ion guide in the axial direction.

Additionally or alternatively, a travelling DC voltage may be applied to the electrodes in order to urge ions though the ion guide in the axial direction. That is, a DC voltage may be successively applied to different axially spaced electrodes (of one or more or each first group of electrodes) so as to create a travelling DC potential barrier that travels in the axial direction so as to urge ions within the ion guide in the axial direction.

According to various embodiments, the ion guide comprises a linear, straight ion guide, i.e. the central axis of the ion guide (and the axial direction) comprises a straight line. However, it would also be possible for the ion guide to be curved, kinked or otherwise non-linear. In this case, the central axis of the ion guide (and the axial direction) may comprise a curved line, kinked line, or other non-straight line.

According to various embodiments, one or more or each of the electrodes of the multipole ion guide comprises a curved metal sheet, a curved metal plate, or a curved metal strip.

The or each electrode may be formed form any suitable metal, such as for example, steel, stainless steel, copper, gold, aluminium, etc.

The or each electrode is formed from a metal sheet, plate or strip. Thus, each electrode is formed from a (single) (monolithic) piece of metal that is relatively thin in one (thickness) dimension, and relatively extended in the other two (width and length) dimensions.

The metal sheet, plate or strip should be thin enough (in the first (thickness) dimension) that it can be bent into its desired curved form (in a relatively straightforward manner), but thick enough (in the first (thickness) dimension) to be substantially rigid (i.e. to retain its rigidity once it has been bent into the desired curved form). Suitable thicknesses for the metal sheet, plate or strip are (i) <0.2 mm; (ii). 0.2-0.3 mm; (iii) 0.3-0.4 mm; (iv) 0.4-0.5 mm; (v) 0.5-0.6 mm; (vi) 0.6-0.7 mm; (vii) 0.7-0.8 mm; (viii) 0.8-0.9 mm; (ix) 0.9-1.0 mm; or (v) >1 mm. For example, in one embodiment, the metal sheet, plate or strip has a thickness around 0.5 mm (other arrangements would, of course, be possible).

It would also or instead be possible for one or more or each electrode to be formed by coating a substrate with a metal layer. In these embodiments, the substrate need not be metal, and may be, e.g. plastic, ceramic, or some other (e.g. rigid) material. In these embodiments, the curved metal sheet will comprise a metal layer, i.e. that is coated onto a substrate. In these embodiments, the metal sheet may be substantially thinner, i.e. <0.1 mm (e.g. since the metal sheet in itself need not be substantially rigid).

The precise size of the metal sheet, plate or strip in the other two (relatively extended) (width and length) dimensions can be selected as desired, i.e. depending on the requirements of the electric field that it is desired to produce within the ion guide. Suitable widths and/or lengths for the metal sheet, plate or strip may be of the order of a few millimetres, a few centimetres, or a few tens of centimetres, etc. For example, in one embodiment, the metal sheet, plate or strip may have a width of around 5 mm and a length of around 15 mm (other arrangements would, of course, be possible).

The or each (single) (monolithic) piece of metal that is used to form an electrode may have a substantially square aspect ratio or a substantially rectangular aspect ratio (in the two relatively extended (width and length) dimensions). According to various embodiments, the metal sheet, plate or strip is relatively long in one (length) of the dimensions, and relatively narrow in the other (width) dimension, i.e. comprises a metal strip.

The or each electrode is curved, i.e. has a form that corresponds to a curved surface. That is, each electrode may be bent or warped (i.e. not (other than) flat).

Each electrode should be (and in various embodiments is) curved (only) in the (thickness) dimension in which it is thin. According to various embodiments, each electrode is curved only in one (thickness) dimension.

Each electrode may be arranged in the ion guide such that the (curved) surfaces (faces) of the electrode (the two relatively extended (width and length) dimensions) are substantially parallel to the axial (z) direction.

In various embodiments, each electrode is initially formed as a (single) (monolithic) flat piece of metal (a flat sheet, plate or strip of metal). This piece of metal may have been cut from a larger sheet of metal. Each such piece of metal may then be bent (in one (thickness) dimension) into its curved form. Thus, the or each electrode may comprise a (single) (monolithic) flat metal sheet, plate or strip that has been bent into a curved metal sheet, plate or strip.

This represents a particularly convenient and straightforward process by which the electrodes can be produced. This in turn results in an ion guide having a reduced production cost.

However, according to various other embodiments (as described above), each electrode may be formed by coating a substrate with a metal layer (by metalising the substrate).

The form of the metal sheet, plate or strip and/or the form in which (into which) the metal sheet, plate or strip is curved can be selected as desired.

According to various embodiments, at least part of the curved metal sheet, plate or strip electrode may have a substantially regular or deformed J-shape or hook-shape. The curved metal sheet, plate or strip electrode may have a substantially regular or deformed U-shape or horseshoe-shape.

According to various embodiments, the metal sheet, plate or strip has a form that includes two legs and a curved portion. The two legs may be provided at opposite extremes of the (single) (monolithic) piece of metal (the metal sheet, plate or strip), and may be (integrally) joined together by the curved portion.

The legs may be substantially flat, substantially parallel, and may have flat faces that face one another. The electrode may be arranged in the ion guide such that the faces of the legs are substantially parallel to the axial (z) direction.

Each of the legs may comprise a main leg body and a protrusion (or more than one protrusion). Each protrusion may be provided at an extreme of the metal sheet, plate or strip, and may be (integrally) joined to the curved portion via the main leg body.

However, according to various other embodiments, each of the legs may (only) comprise a protrusion (i.e. without a main leg body).

Each protrusion may be configured to engage with (to be insertable into) a hole or slot in a rigid support member (as will be described in more detail below).

Each protrusion may be narrower (in the width dimension) than the curved portion and/or the main leg body, i.e. so that only the protrusion (and not the curved portion and/or the leg body) can be inserted in to the hole or slot in the rigid support member. Suitable widths for each protrusion are (i) <0.3 mm; (ii). 0.3-0.4 mm; (iii) 0.4-0.5 mm; (iv) 0.5-0.6 mm; (v) 0.6-0.7 mm; (vi) 0.7-0.8 mm; (vii) 0.8-0.9 mm; (viii) 0.9-1.0 mm; or (ix) >1 mm. For example, in one embodiment, one or more or each protrusion has a width around 0.6 mm (other arrangements would, of course, be possible).

Each protrusion may have any suitable length. Each protrusion may have a length such that when the protrusion is fully inserted into the corresponding hole or slot in the rigid support member, at least a part of the protrusion protrudes beyond the surface of the rigid support member. Alternatively, each protrusion may have a length such that when the protrusion is fully inserted into the corresponding hole or slot in the rigid support member, the protrusion does not protrude beyond the surface of the rigid support member. Suitable lengths for each protrusion are (i) <0.5 mm; (ii). 0.5-1 mm; (iii) 1-1.5 mm; (iv) 1.5-2 mm; (v) 2-2.5 mm; (vi) 2.5-3 mm; (vii) 3-3.5 mm; (viii) 3.5-4 mm; or (ix) >4 mm. For example, in one embodiment, one or more or each protrusion has a length around 2.6 mm (other arrangements would, of course, be possible).

Where present, each main leg body may have a width, e.g. equal to the width of the curved portion. Each main leg body may have any suitable length, e.g. depending on the requirements of the electric field that it is desired to produce within the ion guide, etc.

Each main leg body may comprise one or more (e.g. two) recesses, that may be immediately adjacent to the corresponding protrusion. This ensures that when each protrusion is fully inserted into the corresponding hole or slot in the rigid support member, the electrode will lie flat with respect to the surface of the rigid support member. This helps to ensure that each electrode is precisely aligned with all of the other electrodes.

Thus, according to various embodiments, one or more or each electrode comprises a single (monolithic) sheet, plate or strip of metal comprising two legs joined by a curved portion. Each leg may comprise a protrusion that is configured to engage with (to be inserted into) a hole or slot in a rigid support member. Each electrode may be configured such that when the or each protrusion is fully engaged with (fully inserted into) the corresponding hole or slot of the rigid support member (i.e. such that the curved portion and/or the main leg body is in contact with a surface of the rigid support member), the electrode is aligned with one or more other electrodes of the ion guide, e.g. with the other electrodes of one or more of the groups of electrodes.

This represents a particularly simple and convenient technique for assembling the ion guide. In particular, according to various embodiments, each electrode is precisely located within the ion guide (and therefore precisely aligned with respect to the other electrodes) by means of the interaction between the electrode and the corresponding hole or slot in the rigid support member. This negates the need, e.g. to precisely tighten a screw, or otherwise.

The or each curved portion may have any suitable form, i.e. any suitable profile of curvature. The profile of curvature may be selected depending on the requirements of the electric field that it is desired to produce within the ion guide. Indeed, a particular benefit of the use of curved metal sheet, plate, or strip electrodes is that they can be formed to have any desired curved profile in a relatively convenient and straightforward manner (i.e. by appropriately bending the metal sheet, plate or strip).

According to various embodiments, the or each electrode has a rectangular, round, hyperbolic or other profile. Thus, each curved portion may have a rectangular, round, hyperbolic or other profile.

One or more or each electrode may be arranged in the ion guide such that the curved surfaces (faces) of the curved portion are substantially parallel to the axial (z) direction.

Thus, according to various embodiments, one or more or each electrode of the ion guide comprises a sheet, plate or strip of metal comprising two legs joined by a rectangular, round, hyperbolic or other curved portion.

The plural electrodes of the ion guide may include electrodes having different shapes and/or forms. For example, a curved, kinked or otherwise non-linear ion guide could be formed using electrodes having different sizes (e.g. different leg lengths).

However, according to various embodiments, plural, most or all of the electrodes are substantially identical. This means that the electrodes can in effect be mass produced, and also simplifies the assembly of the ion guide, thereby reducing the production cost of the ion guide.

According to various embodiments, the ion guide comprises one or more rigid support members, and one or more or each of the plural electrodes is attached to a (single) rigid support member.

Each rigid support member may be substantially flat (i.e. planar). Each rigid support member may comprise a printed circuit board (PCB), such as a glass epoxy (e.g. FR4) printed circuit board or otherwise.

However, it would be possible for one or more or each rigid support member to be non-flat (non-planar), e.g. to form a curved, kinked or otherwise non-linear ion guide (and in various embodiments this is the case).

Each rigid support member may comprise one or plural holes or slots, where one or more or each hole or slot is configured to receive a (single) protrusion of an electrode. The plural holes or slots may be arranged such that plural electrodes can be attached to the rigid support member, i.e. by inserting respective electrode protrusions into each hole or slot.

Thus, one or more or each electrode may be attached to a rigid support member by inserting the electrode's protrusion or protrusions into corresponding holes or slots in the rigid support member.

One or more or each hole or slot may extend all the way through the rigid support member and/or one or more or each hole or slot may extend only partially through the rigid support member.

It would be possible for one or more or each electrode to be attached to a rigid support member by means of an interference fit, e.g. between one or more protrusions and one or more holes or slots (and in various embodiments this is the case). However, according to various embodiments, one or more or each electrode is (fixedly) attached to the rigid support member after one or more of its protrusions have been inserted into one or more corresponding holes or slots. For example, one or more or each electrode may be soldered to its respective rigid support member. This ensures that the electrodes are properly attached to the rigid support member, and facilitates an electrical contact between the rigid support member (e.g. PCB) and the electrode.

It will accordingly be appreciated that, in various embodiments, one or more or each electrode of the multipole ion guide is attached to a rigid support member by inserting each electrode protrusion into a corresponding hole or slot of the rigid support member, and then soldering each protrusion to the rigid support member.

This represents a particularly simple and convenient technique for assembling the ion guide. In particular, this means that at least part of the assembly process can be automated. For example, the multiple solder connections between the plural electrodes and the rigid support member can be made by means of automated wave soldering. This in turns means that the multipole ion guide is significantly easier to produce and assemble, e.g. when compared with the known multipole ion guide of FIGS. 1 and 2.

According to various embodiments, where an electrode is attached to a rigid support member using soldering, the electrode may be coated in order to improve the solder connection, e.g. using gold (i.e. one or more electrodes may be gold plated).

Other techniques for attaching an electrode to a rigid support member include, for example, braising, clamps, spring clips, laser welding, conductive glue (e.g. silver loaded glue), and the like.

Each rigid support member may have any plural number of holes or slots, and may be configured such that any plural number of electrodes can be attached to it.

It would be possible for the electrodes of a group of electrodes to be attached to plural rigid support members (and in various embodiments this is the case). However, according to various embodiments, all of the electrodes in a group of electrodes are attached to a single rigid support member. This ensures that all of the electrodes in each group of electrodes are properly aligned with one another (when they are attached to the rigid support member).

It would be possible for each group of electrodes to be attached to its own rigid support member (e.g. as is the case in the known ion guide of FIGS. 1 and 2) (and in various embodiments this is the case). However, according to various embodiments, the electrodes of (only) two groups of electrodes are (all) attached to a single rigid support member. As such, each rigid support member may have two parallel rows of electrodes attached to it. This has the effect of simplifying the assembly of the ion guide, and ensures that the electrodes in the two group of electrodes are properly aligned with one another (when they are attached to the rigid support member).

Thus, according to various embodiments, where the multipole ion guide comprises a quadrupole ion guide, the ion guide may comprise two rigid support members; where the ion guide comprises a hexapole ion guide, the ion guide may comprise three rigid support members; where the ion guide comprises an octopole ion guide, the ion guide may comprise four rigid support members; where the ion guide comprises a decapole ion guide, the ion guide may comprise five rigid support members; where the ion guide comprises a dodecapole ion guide, the ion guide may comprise six rigid support members; and so on.

It would also be possible for the electrodes of more than two groups of electrodes to be (all) attached to a single rigid support member. For example, some, most or all of the electrodes of the ion guide may be attached to a single rigid support member.

As such, according to various embodiments, the ion guide comprises one or more rigid support members, where plural electrodes are attached to each rigid support member. Each rigid support member may be arranged in the ion guide such that its (flat) faces are substantially parallel to the axial (z) direction.

The plural rigid support members may be appropriately aligned with one another, i.e. so that all of the plural groups of electrodes are appropriately aligned with one another. This may be done, e.g. by attaching the rigid support members to one another, e.g. by attaching each rigid support member to one or more other rigid supports (e.g. using screws or otherwise).

It will accordingly be appreciated that, according to various embodiments, the ion guide comprises one or more electrode assemblies, where each electrode assembly comprises a rigid support member (e.g. PCB) and plural electrodes attached to the rigid support member. The ion guide may comprise plural groups of electrodes that are angularly spaced apart from one another, where each group of electrodes comprises plural electrodes that are axially spaced apart from one another (i.e. a multipole ion guide), and each electrode assembly may comprise the electrodes of one, two, or more, such groups of electrodes.

It will furthermore be appreciated that, in various embodiments, each electrode is in the form of a loop, and that the plural electrodes of each electrode group are aligned with one another. This means that cleaning the ion guide is greatly simplified. In particular, the configuration of the ion guide according to various embodiments is such that cleaning fluid can easily reach all of the surfaces of the electrodes, and that cleaning fluid is less likely to become trapped in the spaces between electrodes. This means that it is not necessary to (completely) disassemble the ion guide when it is desired to clean the ion guide. For example, each electrode assembly can be thoroughly cleaned without being disassembled. This in turn results in an ion guide that has an improved production yield, reduced maintenance cost, and improved performance.

Each electrode assembly may comprise one or more electrical contacts for receiving one or more (RF and/or DC) voltages that are to be applied to the electrodes.

Each (PCB of each) electrode assembly may comprise suitable wires, conductive tracks, electrical components, etc., to allow a received (RF and/or DC) voltage to be appropriately applied to one or more or all of the electrodes (e.g. in the manner described above).

Each electrode assembly may also comprise one or more electrical contacts for transmitting a received (RF and/or DC) voltage to one or more other electrode assemblies.

This arrangement means that only one of the plural electrode assemblies needs to be directly connected to the (RF and/or DC) voltage source(s), while the (RF and/or DC) voltage can be transmitted from that one electrode assembly to the other electrode assemblies of the ion guide. This represents a particularly convenient and simple arrangement for applying the desired voltages to the electrodes, since for example, only a relatively small number of cables and connections are required for appropriately connecting the voltage source(s) to the electrodes.

According to various embodiments, each electrode assembly comprises a first electrical contact (or group of electrical contacts) for receiving a first phase of an RF voltage (optionally together with a DC voltage), and a second (different) electrical contact (or group of electrical contacts) for receiving the opposite phase of the RF voltage (optionally together with a DC voltage). According to various embodiments, each electrode assembly comprises a first electrical contact (or group of electrical contacts) for transmitting the first phase of the RF voltage (optionally together with a DC voltage) to one or more other electrode assemblies, and a second (different) electrical contact (or group of electrical contacts) for transmitting the opposite phase of the RF voltage (optionally together with a DC voltage) to one or more other electrode assemblies.

In this regard, the electrode assembly is, in various embodiments, configured such that the opposite phases of the RF voltage are spatially separated within the electrode assembly (within the printed circuit board). In particular, the relevant conductive elements within the printed circuit board, and the electrodes themselves, are sufficiently spaced apart that electrical breakdown will not occur.

In addition, the electrode assembly is, in various embodiments, configured such that is not necessary to include crossovers within the printed circuit board that carry opposite phases of the RF voltage. This can reduce the risk of electrical breakdown within the printed circuit board, and/or can allow a less resistive, e.g. cheaper, printed circuit board to be used, thereby reducing the production cost of the ion guide.

According to various embodiments, each electrode assembly comprises electrodes of two (or more) groups of electrodes, and the minimum separation within the printed circuit board between the opposite phases of the RF voltage is the distance between the electrode legs of respective groups. According to various embodiments, this minimum distance can be increased, e.g. by appropriately configuring the electrodes. For example, one or more or each electrode may have a stepped in electrode leg. Other arrangements would, however, be possible.

The plural electrode assemblies of the ion guide may include one or more electrode assemblies having different configurations. However, according to various embodiments, plural, most or all of the electrode assemblies are substantially identical. This means that the electrode assemblies can in effect be mass produced, and also simplifies the assembly of the ion guide, thereby reducing the production cost of the ion guide.

The ion guide according to various embodiments may be operated in a vacuum or non-vacuum. The ion guide according to various embodiments may be used as desired in a mass and/or ion mobility spectrometer, e.g. "purely" as an ion guide, to guide ions as they are being separated according to their ion mobility (i.e. in an ion mobility separator), or to guide ions as they are being fragmented or reacted (i.e. in a fragmentation, reaction or collision cell), etc. Other arrangements would be possible.

Figure 3:
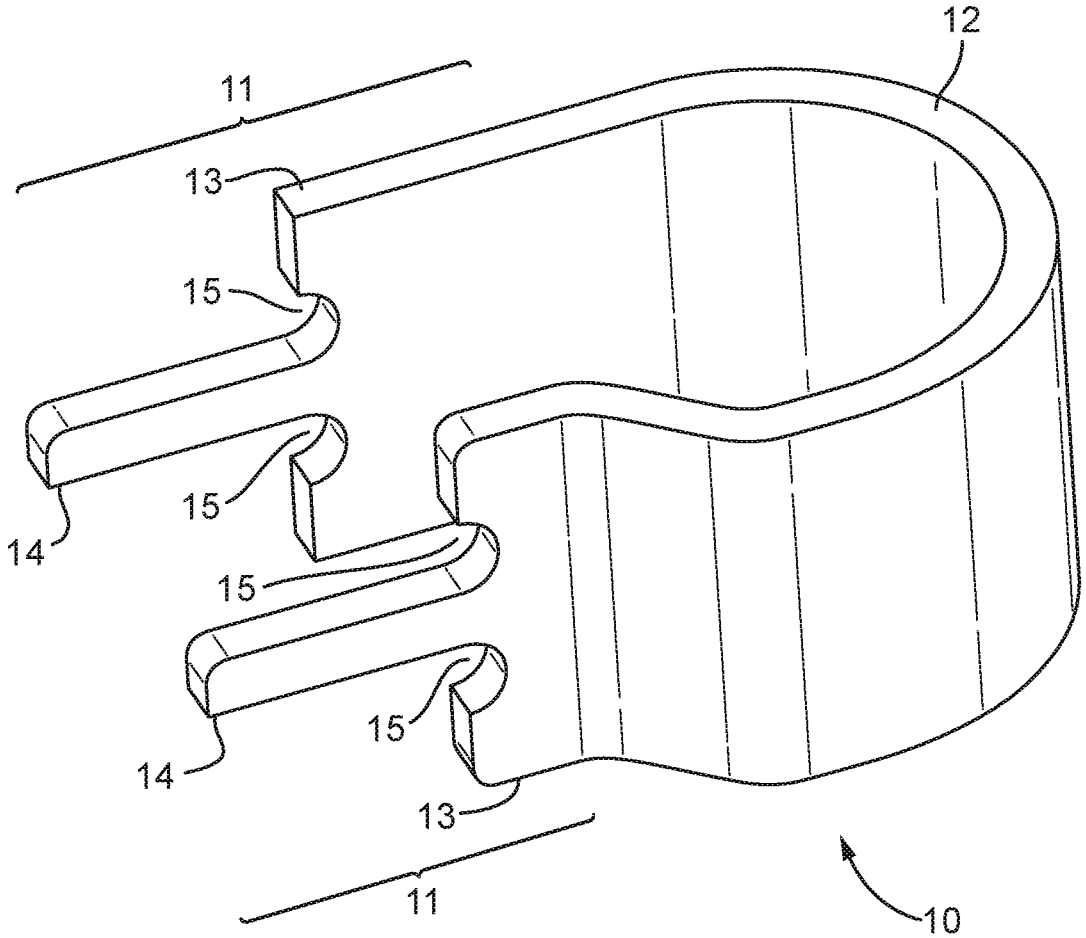
FIG. 3 shows schematically an electrode for a multipole ion guide in accordance with various embodiments.
Figure 4A:
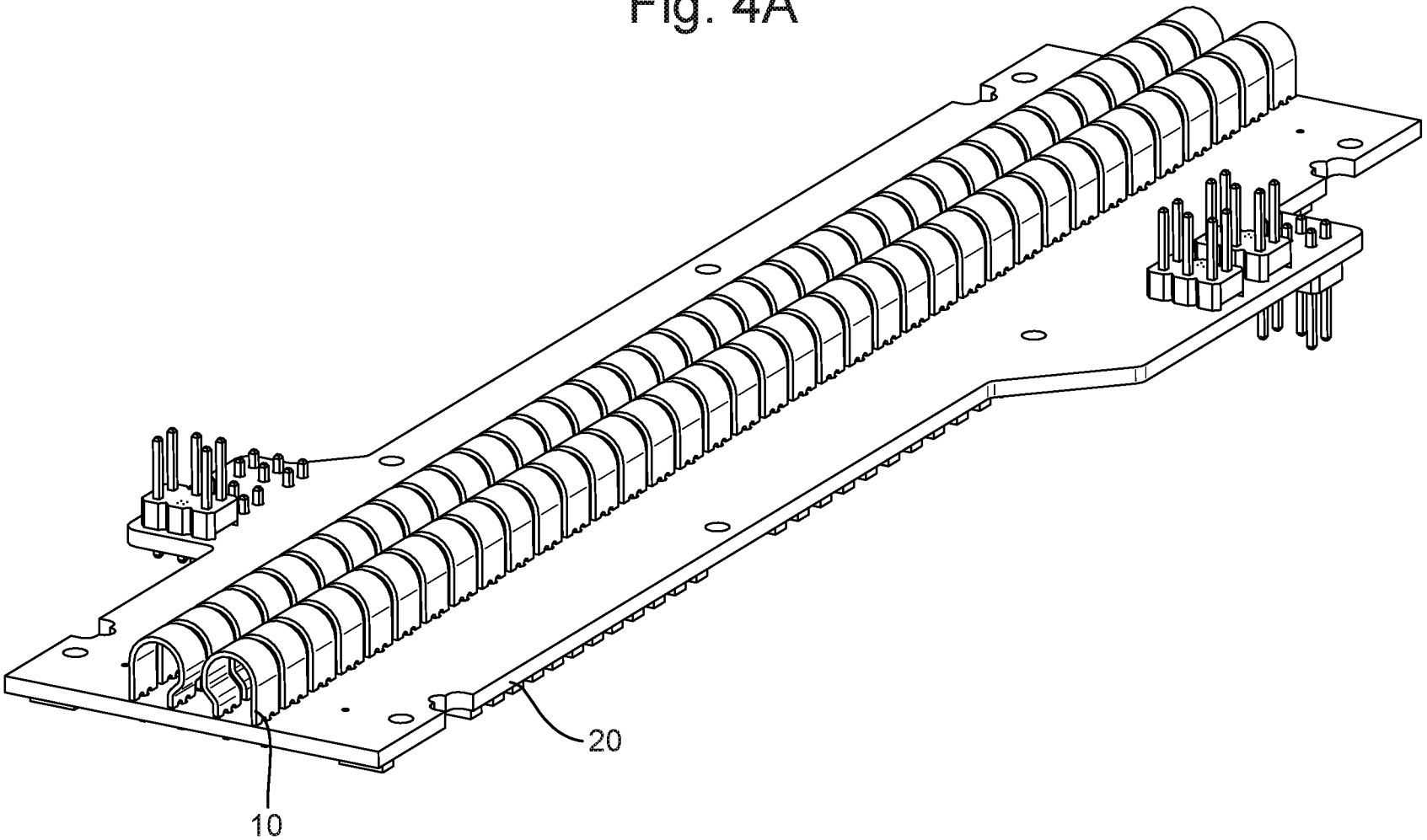
FIG. 4A shows schematically a perspective view of a printed circuit board for a multipole ion guide in accordance with various embodiments.
Figure 4B:
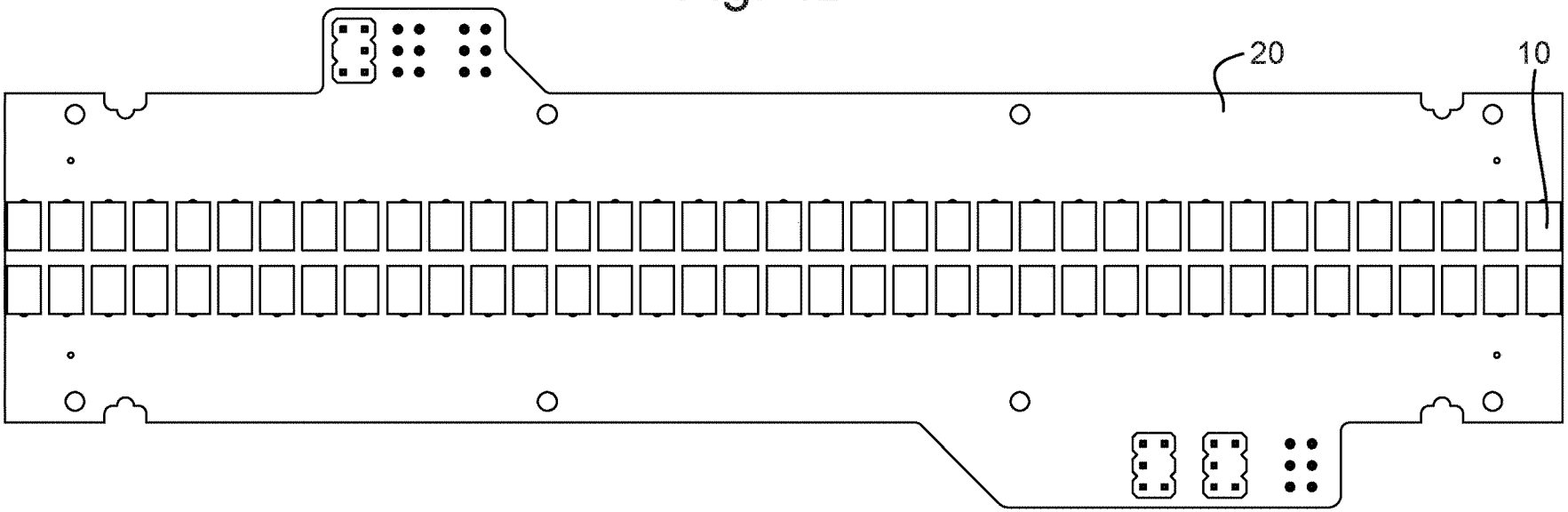
FIG. 4B shows schematically a top view of a printed circuit board for a multipole ion guide in accordance with various embodiments.
Figure 4C:
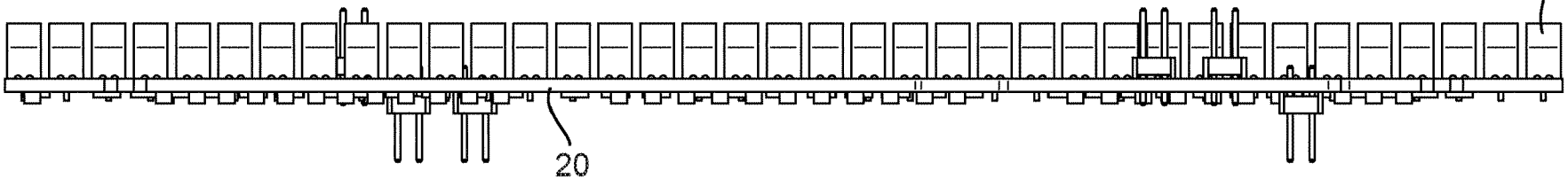
FIG. 4C shows schematically a side view of a printed circuit board for a multipole ion guide in accordance with various embodiments.
Figure 4D:
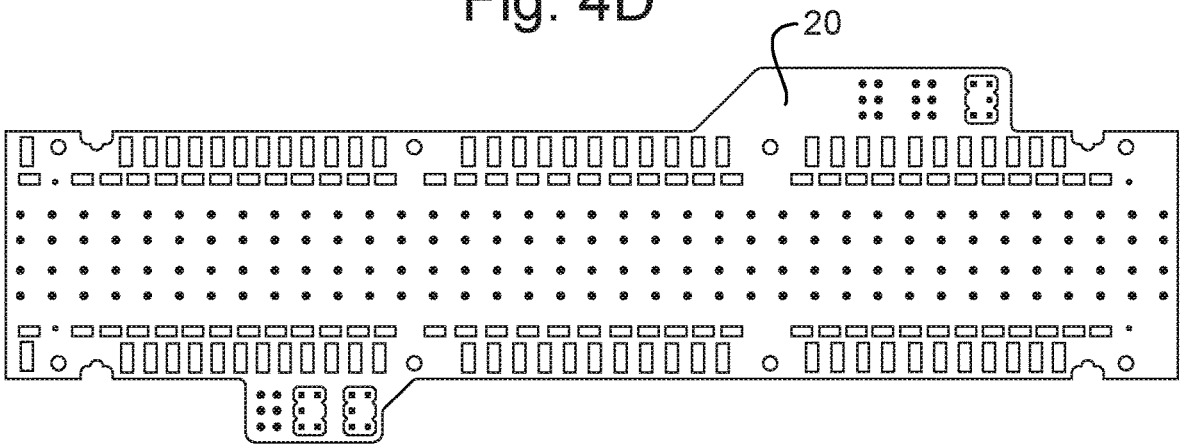
FIG. 4D shows schematically a bottom view of a printed circuit board for a multipole ion guide in accordance with various embodiments.
Figure 4E:
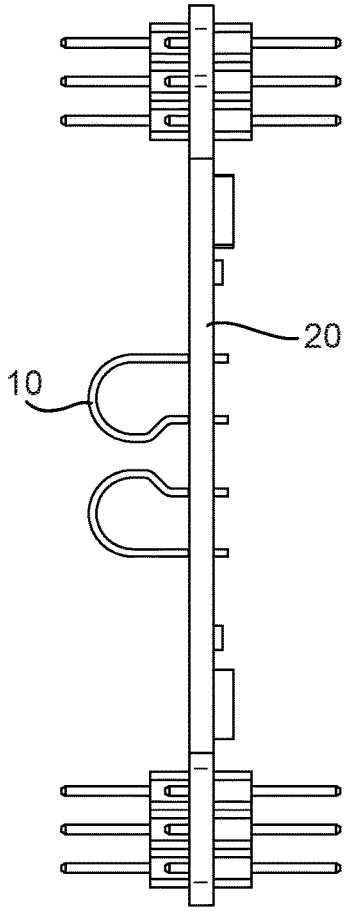
FIG. 4E shows schematically an end on view of a printed circuit board for a multipole ion guide in accordance with various embodiments.

FIG. 3 shows an electrode 10 in accordance with an embodiment. As shown in FIG. 3, the electrode is formed from a metal strip that has been cut from a metal sheet into the desired shape. The metal strip is then bent into the desired curved form.

As shown in FIG. 3, the electrode comprises two leg portions 11 that are joined by an outer curved portion 12.

The electrode illustrated in FIG. 3 is intended for use in a quadrupole ion guide that corresponds to the quadrupole ion guide of FIGS. 1 and 2. As such, the outer curved portion 12 has a round profile. It would, however, be possible for the electrode to comprise any suitable outer profile, such as a hyperbolic, rectangular, or other profile.

The two leg portions 11 are substantially parallel, and spaced apart from and facing one another. As shown in FIG. 3, each leg 11 of the electrode comprises an upper leg body 13, and a lower narrow protrusion 14. Each protrusion 14 is configured such that it can be inserted into a hole in a printed circuit board and attached thereto.

The width of each upper leg body 13 is greater than the width of each protrusion 14. This ensures that when the protrusions 14 are fully inserted into corresponding holes of a printed circuit board, the electrode 10 will adopt a defined position with respect to the printed circuit board. This ensures that each of the plural electrodes 10 of the ion guide are aligned with respect to one another.

Each upper leg body 13 includes two recesses 15 that are adjacent to the protrusion 14. These ensure that when each protrusion 14 is fully inserted into a corresponding hole of the printed circuit board, the electrode 10 will sit flat with respect to the surface of the printed circuit board. This has the effect of increasing the accuracy with which the electrodes 10 of the ion guide are aligned with one another.

In FIG. 3, the electrode 10 also includes a stepped in curved portion 16. This is present in order to ensure that, when plural electrodes 10 are installed in a printed circuit board, the legs of adjacent electrodes 10 (which will receive opposite phases of an RF voltage) are sufficiently separated to avoid electrical breakdown within the printed circuit board. However, in various other embodiments, the stepped in curved portion 16 may not be present.

FIG. 4 illustrates an electrode assembly in accordance with an embodiment. As illustrated in FIG. 4, plural of the electrodes 10 of FIG. 3 are installed in a printed circuit board 20. The protrusions 14 of each electrode 10 are inserted into corresponding holes in the printed circuit board 20, and then each electrode 10 is soldered to the printed circuit board 20.

This represents a particularly straightforward connection, e.g. when compared with the screw connection of the known ion guide of FIGS. 1 and 2. In particular, since each electrode 10 is located in place by the interaction between the printed circuit board 20 and the bottom edge of each upper leg portion 13, it is relatively straightforward to precisely locate each electrode 10 within the ion guide.

Furthermore, this means that the assembly of the ion guide can be (at least partially) automated, e.g. using wave soldering.

Where an electrode 10 is soldered to the printed circuit board 20, the electrode 10 may optionally be gold plated in order to improve the solder connection.

It would, however, be possible to attach the electrodes 10 to the printed circuit board 20 (or to some other rigid support) using some other technique such as for example, braising, clamps, spring clips, laser welding, conductive glue (e.g. silver loaded glue), and the like.

It will be appreciated that the arrangement according to various embodiments ensures that cleaning of the ion guide is relatively straightforward. This is because, as can be seen from FIG. 4, even when all of the electrodes 10 are installed in the printed circuit board 20, cleaning fluid can pass freely inside each electrode 10. This means that it is relatively straightforward to ensure that cleaning fluid reaches all parts of the ion guide, and that cleaning fluid is less likely to become trapped between the electrodes 10. As such, the ion guide need not be entirely disassembled for cleaning.

Figure 5A:
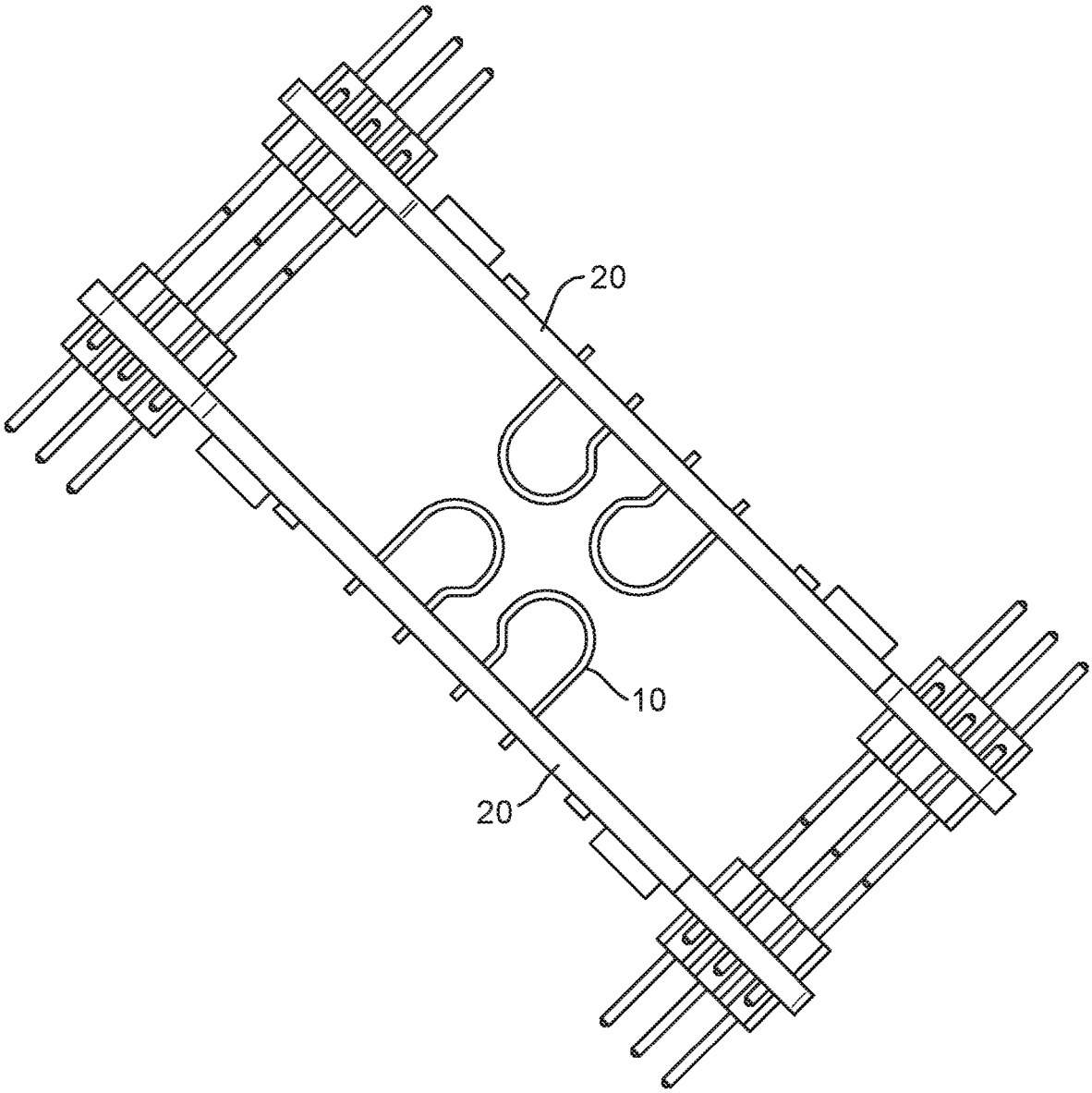
FIG. 5A shows schematically an end on view of a multipole ion guide in accordance with various embodiments.
Figure 5B:
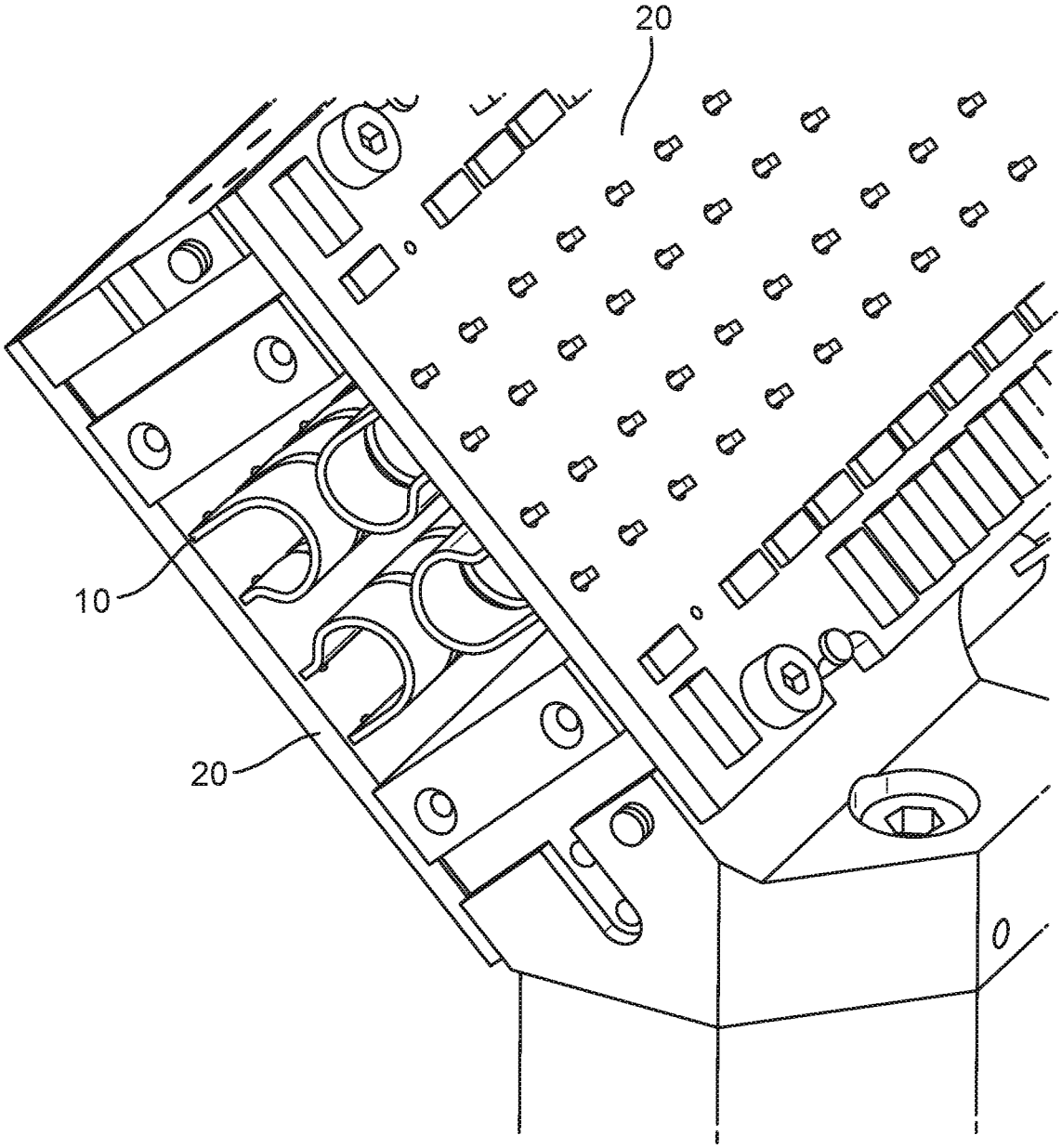
FIG. 5B shows schematically a perspective view of a multipole ion guide in accordance with various embodiments.

FIG. 5 illustrates a quadrupole ion guide in accordance with various embodiments. As illustrated by FIG. 5, the electrodes 10 of two groups of electrodes are attached to a single printed circuit board 20. This is in contrast with the known ion guide of FIGS. 1 and 2, whereby the electrodes 1 of a single segmented rod are attached to each printed circuit board 2. This means that the ion guide according to various embodiments is easier to assemble, and cheaper to produce.

Figure 6A:
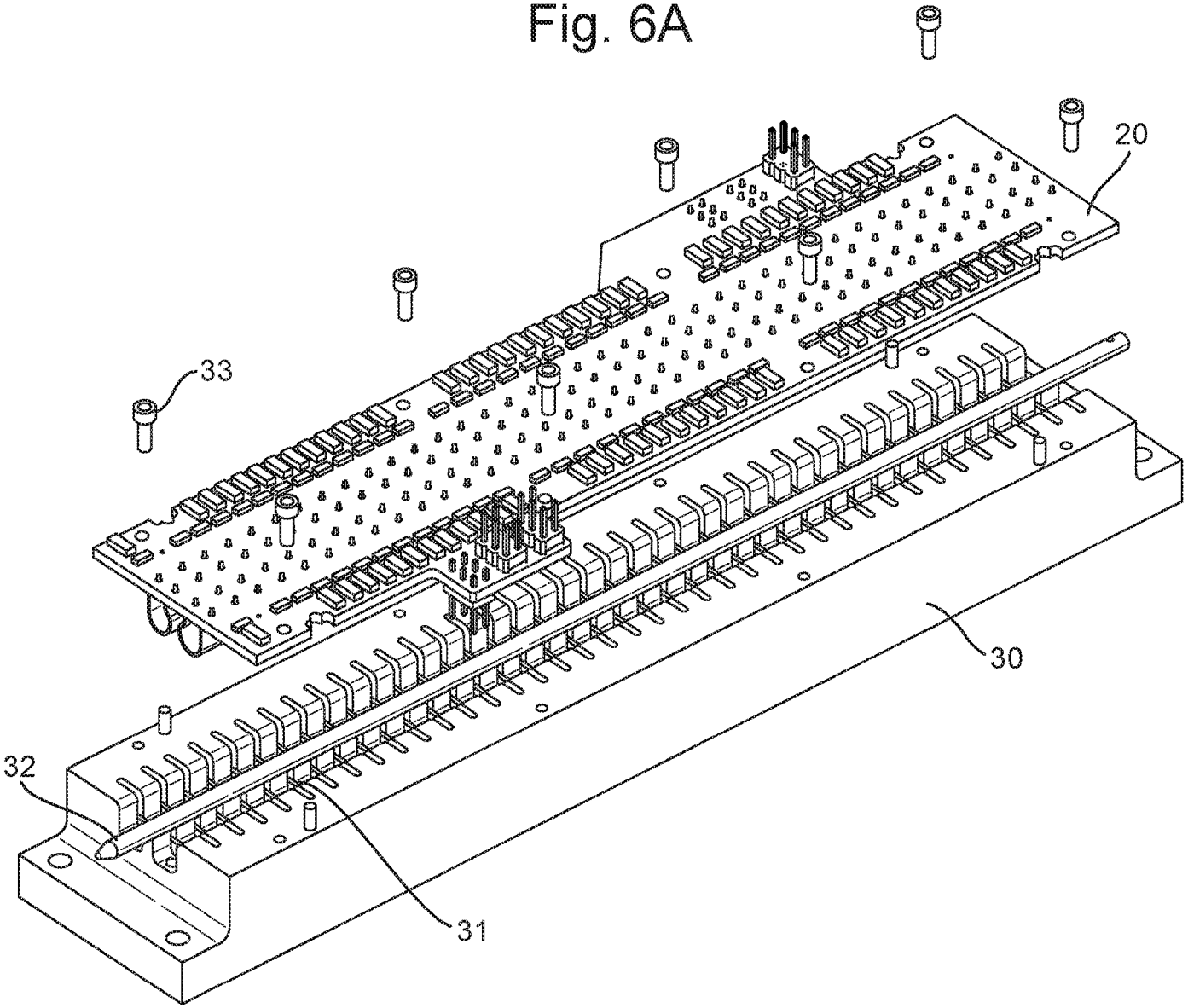
FIGS. 6A and 6B show schematically a method of assembling a printed circuit board for a multipole ion guide in accordance with various embodiments.
Figure 6B:
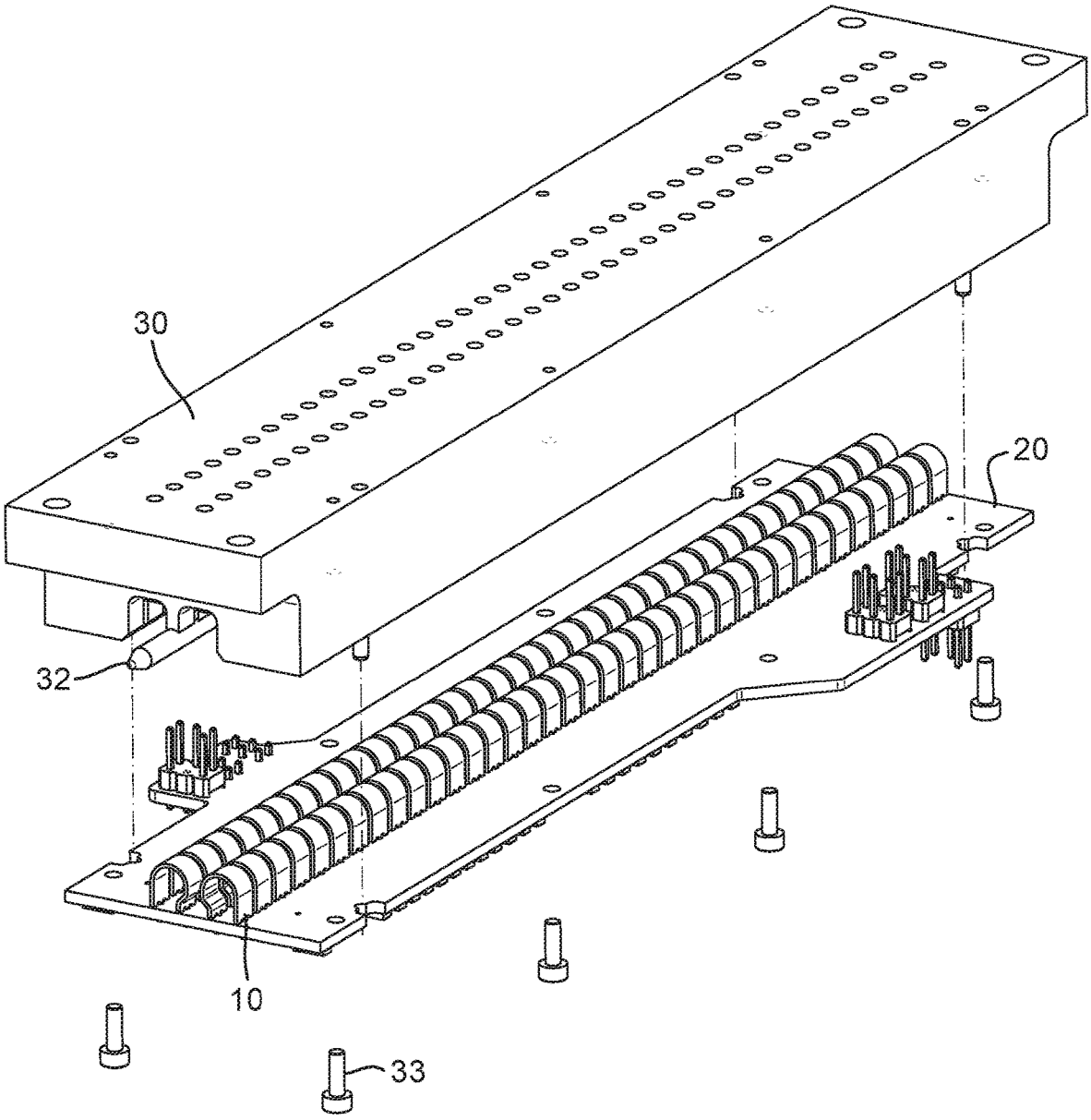

FIG. 6 illustrates a method by which the electrode assembly may be formed. FIG. 6A shows a top view, and FIG. 6B shows a bottom view.

Plural electrodes 10 are arranged inside a custom built jig 30. As shown in FIG. 6A, the jig includes plural bays or pockets 31, each configured to receive and hold an electrode 10.

Once all of the bays 31 have been filed with electrodes 10, a rod 32 is inserted between the electrodes to ensure that the electrodes 10 are properly aligned within the jig 30.

A printed circuit board 20 is then lowered down onto the jig 30, such that each protrusion 14 of each electrode 10 is inserted into a corresponding hole in the printed circuit board 20. The board 20 may be temporarily attached to the jig 30 by screws 33.

The electrodes 10 are then soldered to the board 20. This can be done manually or automatically, e.g. using wave soldering techniques.

Finally, the jig 30 is separated from the printed circuit board 20 and electrode 10 assembly.

It will be appreciated that these assemblies can be mass produced in a straightforward and low cost manner.

Figure 7:
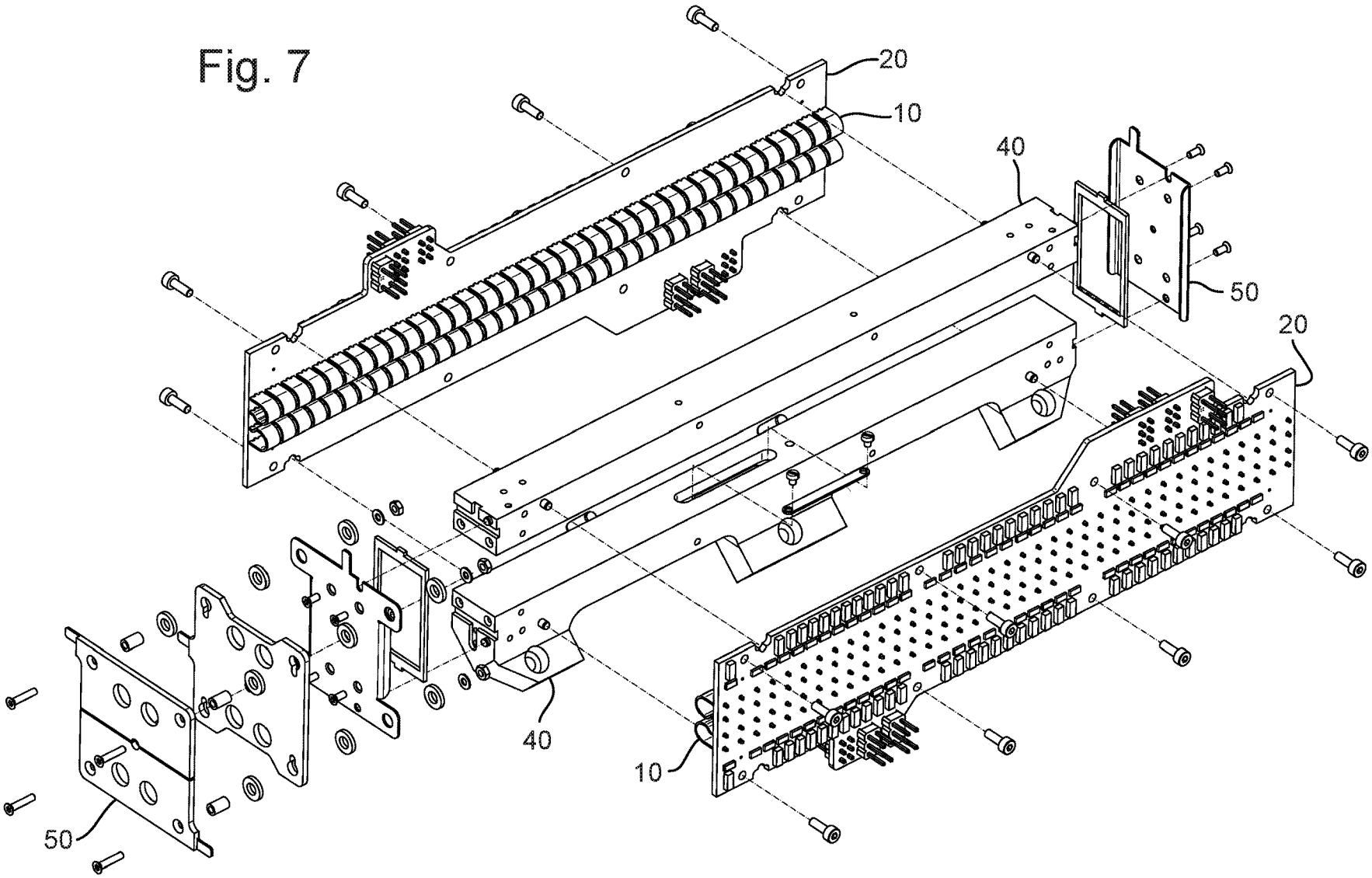
FIG. 7 shows schematically a method of assembling a multipole ion guide in accordance with various embodiments.

As illustrated in FIG. 7, two of these assemblies may then be assembled into an ion guide. This is done by attaching each printed circuit board assembly to one or more rigid supports 40. One or more ion entrance/exit and/or ends plates 50 may also be attached to form the completed ion guide.

Figure 8:
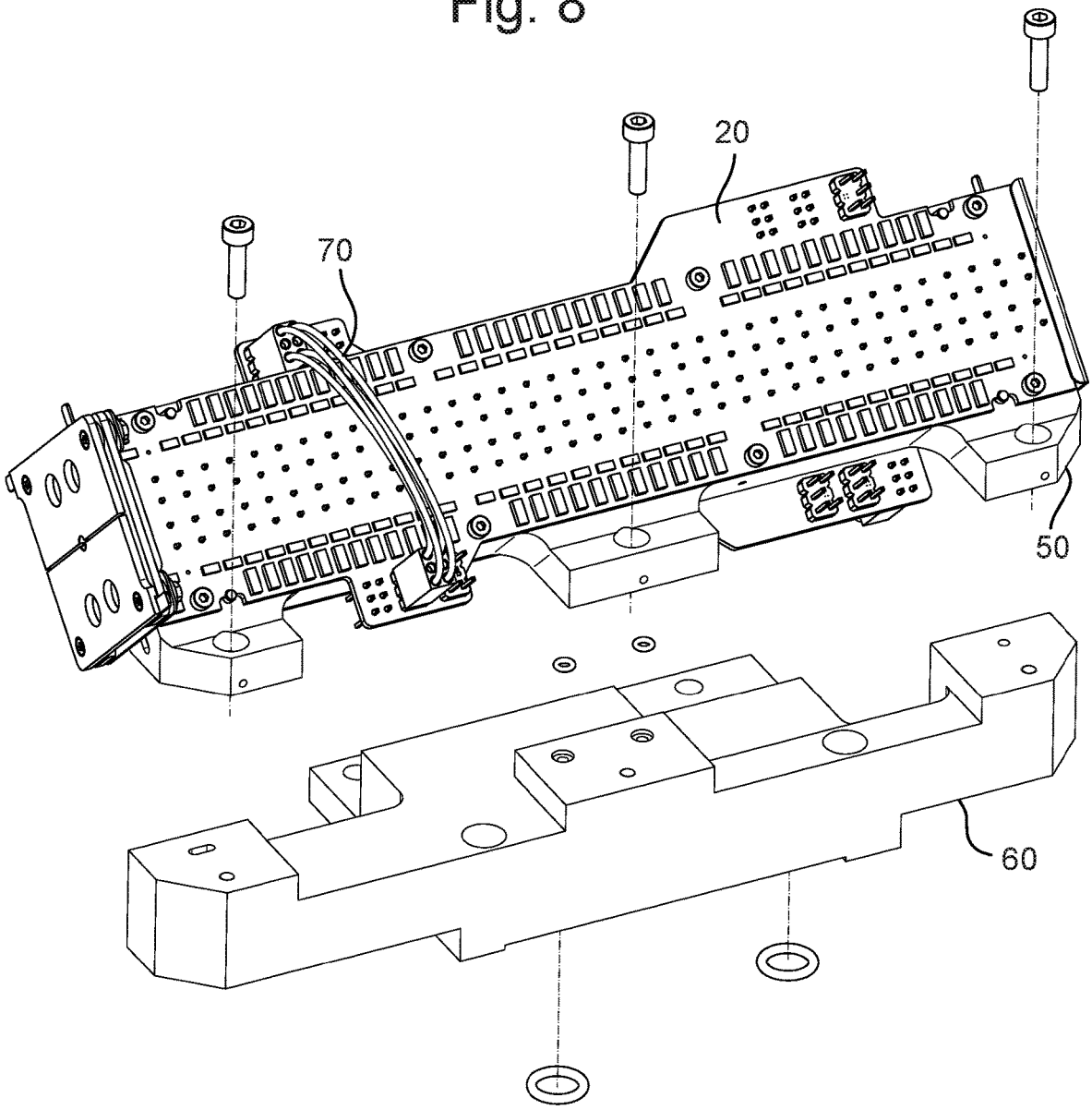
FIG. 8 shows schematically a method of assembling a multipole ion guide in accordance with various embodiments.

As illustrated in FIG. 8, the ion guide assembly may be mounted on a base 60.

Figure 9:
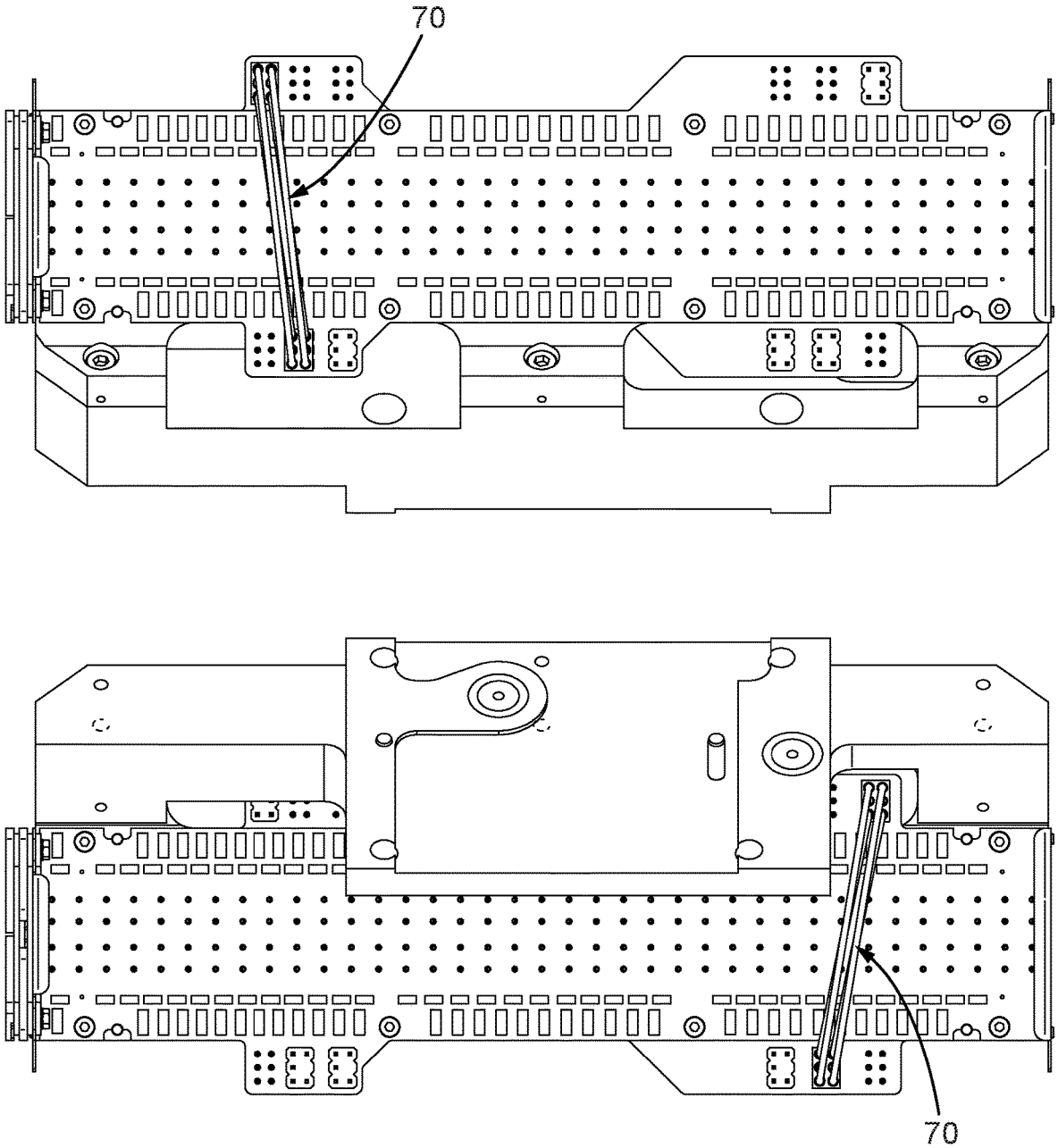
FIG. 9 shows schematically a multipole ion guide in accordance with various embodiments.

In addition, as shown in FIG. 9, the two printed circuit board assemblies may be connected via two link cables 70 to ensure that an applied RF and/or DC voltage is appropriately distributed amongst the electrode 10.

Although FIGS. 3-9 illustrate a quadrupole ion guide, it would be possible to construct other types of multipole ion guide using the techniques according to various embodiments. For example, the ion guide may comprise a quadrupole ion guide, a hexapole ion guide, an octopole ion guide, a decapole ion guide, a dodecapole ion guide, and so on.

Although FIGS. 3-9 illustrate a segmented-type ion guide, it would also be possible to construct a non-segmented ion guide using the techniques of various embodiments. In this case, the ion guide would comprise plural parallel extended electrodes. In this case, each electrode may be attached to a rigid support (e.g. PCB) at multiple points along its length, to ensure stability.

Although FIGS. 3-9 illustrate a linear, straight ion guide, it would also be possible for the ion guide to be curved, kinked or otherwise non-linear. This may be achieved, for example, using multiple printed circuit boards 20, one or more curved or kinked printed circuit boards, and/or differently sized electrodes 10, etc.

Although as described above, the electrodes may be formed by bending an initially flat metal plate or strip, it would also or instead be possible to form electrodes by coating a (e.g. plastic) substrate with a metal layer.

Although the present invention has been described with reference to preferred embodiments, it will be understood by those skilled in the art that various changes in form and detail may be made without departing from the scope of the invention as set forth in the accompanying claims.

The invention claimed is:

1. An ion guide comprising:

a plurality of electrodes arranged to form a multipole ion guide, wherein the plurality of electrodes comprises one or more groups of electrodes, and each group of electrodes comprises plural electrodes that are axially spaced apart from one another; and one or more rigid support members, wherein the electrodes of one or more groups of electrodes are attached to one of the one or more rigid support members wherein one or more of the electrodes comprises a curved metal sheet, plate or strip;

wherein the plurality of electrodes comprises plural groups of electrodes that are angularly spaced apart from one another; and wherein the electrodes of two of the angularly spaced groups of electrodes are attached to a single rigid support member wherein the curved metal sheet, plate or strip electrode comprises one or more legs and a curved portion.

2. The ion guide of claim 1, further comprising:

a radio frequency (RF) voltage source configured to apply an RF voltage to the electrodes; and/or a DC voltage source configured to apply a DC voltage gradient to the electrodes; and/or a DC voltage source configured to apply a travelling DC voltage to the electrodes.

3. The ion guide of claim 1, wherein:

the metal sheet, plate or strip is thinner in a first dimension than in a second dimension and a third dimension; and the metal sheet, plate or strip is curved in the first dimension.

4. The ion guide of claim 1, wherein:

the curved metal sheet, plate or strip comprises two curved faces; and the curved metal sheet, plate or strip electrode is arranged such that the two curved faces are parallel to an axial direction of the ion guide.

5. The ion guide of claim 1, wherein the curved portion has a rectangular, round or hyperbolic profile.

6. The ion guide of claim 1, wherein the curved metal sheet, plate or strip electrode has a substantially regular or deformed J-shape, hook-shape, U-shape or horseshoe-shape.

7. The ion guide of claim 1, wherein:

each curved metal sheet, plate or strip electrode comprises one or more protrusions;

each rigid support member comprises plural holes; and each electrode protrusion is arranged inside a hole of a rigid support member.

8. The ion guide of claim 1, wherein each curved metal sheet, plate or strip electrode is soldered to one of the one or more rigid support members.

9. The ion guide of claim 1, wherein each curved metal sheet, plate or strip electrode is directly attached only to a single rigid support member.

10. The ion guide of claim 1, wherein:

the electrodes of first and second angularly spaced groups of electrodes are attached to a first rigid support member;

the electrodes of third and fourth angularly spaced groups of electrodes are attached to a second rigid support member; and the first rigid support member is attached to the second rigid support member.

11. An assembly for a multipole ion guide comprising:

a rigid support member; and a plurality of electrodes attached to the rigid support member;

wherein one or more of the electrodes comprises a curved bent metal sheet, a curved bent metal plate or a curved bent metal strip; and wherein the plurality of electrodes comprises two parallel rows of electrodes attached to the rigid support member wherein the curved metal sheet, plate or strip electrode comprises one or more legs and a curved portion.

12. The assembly of claim 11, wherein:

each curved bent metal sheet, curved bent metal plate or curved bent metal strip electrode comprises one or more protrusions;

the rigid support member comprises a plurality of holes; and each protrusion is arranged inside a hole of the rigid support member.

13. A method of guiding ions comprising:

providing an ion guide comprising a plurality of electrodes arranged to form a multipole ion guide and one or more rigid support members, wherein the plurality of electrodes comprises one or more groups of electrodes, and each group of electrodes comprises plural electrodes that are axially spaced apart from one another, wherein the electrodes of one or more groups of electrodes are attached to one of the one or more rigid support members, and wherein one or more of the electrodes comprises a curved metal sheet, plate or strip words wherein the electrodes of two of the angularly spaced groups of electrodes are attached to a single rigid support member and the curved metal sheet, plate or strip electrode comprises one or more legs and a curved portion; and applying a radio frequency (RF) voltage to the electrodes in order to radially confine ions within the ion guide.

14. The ion guide of claim 1, wherein one or more of the electrodes comprises a curved bent metal sheet, a curved bent metal plate or a curved bent metal strip.

* * * * *